US007105476B2

(12) United States Patent
Whilton

(10) Patent No.: US 7,105,476 B2
(45) Date of Patent: Sep. 12, 2006

(54) FABRIC TREATMENT COMPOSITIONS COMPRISING ORGANICALLY MODIFIED PARTICLES

(75) Inventor: Nicola Whilton, Wirral (GB)

(73) Assignee: Unilever Home & Personal Care USA Division of Conopco, Inc., Greenwich, CT (US)

( * ) Notice: Subject to any disclaimer, the term of this patent is extended or adjusted under 35 U.S.C. 154(b) by 653 days.

(21) Appl. No.: 10/005,240

(22) Filed: Dec. 5, 2001

(65) Prior Publication Data

US 2002/0107169 A1 Aug. 8, 2002

(30) Foreign Application Priority Data

Dec. 6, 2000 (EP) ..... 00310857

(51) Int. Cl.
*C11D 3/08* (2006.01)

(52) U.S. Cl. ..... 510/334; 510/276; 510/418; 510/460; 510/485; 510/486; 510/511; 510/504

(58) Field of Classification Search ..... 510/276, 510/334, 418, 460, 485, 486, 511, 504
See application file for complete search history.

(56) References Cited

U.S. PATENT DOCUMENTS

| | | | | |
|---|---|---|---|---|
| 3,892,681 | A | 7/1975 | Edwards et al. | |
| 3,936,537 | A | 2/1976 | Baskerville, Jr. et al. | |
| 3,948,790 | A * | 4/1976 | Speakman | 510/330 |
| 4,051,046 | A | 9/1977 | Diehl et al. | |
| 4,062,647 | A | 12/1977 | Storm et al. | |
| 4,292,035 | A | 9/1981 | Battrell | |
| 4,557,854 | A | 12/1985 | Plueddemann | |
| 4,742,039 | A * | 5/1988 | Hanauer et al. | 502/407 |
| 4,844,821 | A * | 7/1989 | Mermelstein et al. | 510/328 |
| 5,443,750 | A | 8/1995 | Convents et al. | |

FOREIGN PATENT DOCUMENTS

| | | |
|---|---|---|
| EP | 0 381 487 | 8/1990 |
| EP | 0 381 487 A1 | 8/1990 |
| GB | 1 400 898 | 7/1975 |
| GB | 1 428 061 | 3/1976 |

OTHER PUBLICATIONS

International Search Report No. No. PCT/EP 01/12580 dated Feb. 25, 2002, 5 pp.
Whilton N.T. et al.: "Hybrid lamellar nanocomposites based on organically functionalized magnesium phyllosilicate clays with interplayer reactivity", J. Mater. Chem., vol. 8, No. 8, 1998, pp. 1927-1932.
European Search Report dated May 29, 2001.
Cao G. et al.: "Layered Metal Phosphates and Phosphonates: From Crystals to Monolayers", Acc. Chem. Res., vol. 25, 1992, pp. 420-427.

* cited by examiner

*Primary Examiner*—Charles Boyer
(74) *Attorney, Agent, or Firm*—Alan A. Bornstein

(57) ABSTRACT

This invention relates to fabric treatment compositions comprising a textile compatible carrier and water insoluble particles having a layered structure comprising oxygen atoms and silicon and/or phosphorus atoms and comprising organic functional groups which are bonded to silicon and/or phosphorus atoms by direct covalent bonds between the silicon and/or phosphorus atoms and a carbon atom. A number of the compositions may impart anti-wrinkling ie, reduced crease formation or other benefits to fabrics washed or otherwise treated therewith.

16 Claims, No Drawings

FABRIC TREATMENT COMPOSITIONS COMPRISING ORGANICALLY MODIFIED PARTICLES

TECHNICAL FIELD

This invention relates to fabric treatment compositions, to their use in the treatment of fabric and to a method of treating fabric with the compositions.

BACKGROUND AND PRIOR ART

It is known that the physical properties of fabrics can be modified by certain treatments. For example, fabric may be treated in order to modify its physical properties either in an industrial pretreatment or during laundering.

Fabrics in general, and cotton in particular, are prone to the formation of creases before, during and after laundering and drying. In order to remove such creases from the fabric, a considerable amount of time and effort must be spent ironing upon each occasion of laundering and drying. The terms "crease" and "wrinkle" and related terms, such as "anti-crease" and "anti-wrinkle", refer to non-permanent deformations in the fabric which can be removed by flattening at elevated temperature and moisture (eg, by ironing) and are used synonymously herein.

Some of the previous attempts to address the problems of crease formation with regard to fabrics have been based on the use of insoluble particulate materials.

U.S. Pat. No. 3,892,681, for example, discloses the use of granular, substantially water-insoluble starch particles having a diameter between 1 to 45: m in detergent compositions. Such particles are said to impart anti-wrinkling and ease of ironing benefits in addition to other fabric conditioning properties.

A detergent composition featuring a substantially water-insoluble particulate material with a diameter from about 5 to 30: m is described in U.S. Pat. No. 4,051,046. The particulate material may be a glass, ceramic or polymer-based bead, or a starch that has been treated with a hydrophobic agent to reduce its water solubility. In order to permit ironing, the particles must have a melting point above 150° C. These compositions are said to confer a range of fabric benefits, including anti-wrinkling and ease of ironing.

The use of smectite clay as a softening agent is disclosed in U.S. Pat. No. 3,936,537. In this document, the clay is combined with a quaternary ammonium salt, which confers anti-static benefits, and a dispersion inhibitor consisting of a solid organic material, in a detergent compatible composition.

Smectite clay is also used in the fabric-softening detergent compositions disclosed in U.S. Pat. No. 4,062,647. Again the clay is said to impart improved softening and/or anti-static characteristics.

A fabric softening detergent composition comprising a synthetic non-soap detergent, builder salt and clay is disclosed in GB 1400898. The clay, added for softening benefits, is a three-layer smectite-type clay with an ion exchange capacity of at least 50 meq/100 g. The combination of builder salt and clay is described as helping prevent agglomeration of the clay, thus allowing efficient deposition of the clay on fabric. In GB 1428061, a similar fabric softening composition is disclosed with a water-insoluble quaternary ammonium salt present as an anti-static agent. The smectite-type clay, responsible for imparting softness benefits, has a particle size below 50 microns and an ion-exchange capacity of at least 50 meq/100 grams.

In U.S. Pat. No. 5,443,750, clay, which may be smectite clay, is used in conjunction with an enzyme in a detergent composition to afford increased softening properties.

EP-A-0 381 487 describes the use of liquid detergent compositions in which a clay (an aluminosilicate eg, smectite) is treated with a barrier material, selected from a siloxane, a polysiloxane, a polyacrylate, dialkyl citrate, alkoxylated dialkyl citrate, alkoxylated glycerol mono- and di-stearates, and alkoxylated N-alkyl alkanolamides, prior to incorporation of the clay into the formulation.

The treatment of a range of water insoluble materials, including clay, with an organosilicon compound bearing a quaternary ammonium group is taught in U.S. Pat. No. 4,557,854. The organosilicon groups are grafted onto the surface of the clay particles and, therefore, will be bound to the silicon atoms in the layers of the clay by way of Si—O linkages. The effect of the treatment is described as being to increase the cleaning power of conventional organic surface-active agents.

The treatment of cotton fabrics with cross-linking agents, such as butane-1,2,3,4-tetracarboxylic acid (BTCA), is known to impart anti-wrinkle properties. However, such treatments tend to make the fabric stiff and relatively easy to tear.

The present invention aims to provide a system which is applicable to the treatment of fabric in order to provide desirable properties in the fabric. Desirable properties which may be achieved in the fabric as a result of treatment with a composition according to the invention include, for example, one or more of the following benefits: anti-wrinkle, increased softness, better shape, improved texture, improved colour (including surface colour definition), better antistatic properties, reduced friction, better comfort in wear, increased water absorption or increased water resistance and/or repellence and better durability (ie, resistance to wear, including anti-pilling and anti-fuzz properties). In a particularly preferred embodiment, the compositions of the invention are used for reducing the extent of creasing of fabric, such as before and/or during and/or after laundering.

DEFINITION OF THE INVENTION

According to the present invention, there is provided a fabric treatment composition comprising a textile compatible carrier and water insoluble particles having a layered structure comprising oxygen atoms and silicon and/or phosphorus atoms, and comprising organic functional groups which are bonded to silicon and/or phosphorus atoms in the layers by direct covalent bonds between the silicon and/or phosphorus atoms and a carbon atom.

In another aspect, the invention provides the use of a fabric treatment composition comprising a textile compatible carrier and water insoluble particles having a layered structure comprising oxygen atoms and silicon and/or phosphorus atoms, and comprising organic functional groups which are bonded to silicon and/or phosphorus atoms in the layers by direct covalent bonds between the silicon and/or phosphorus atoms and a carbon atom, in the treatment of fabric.

A further aspect of the invention relates to a method of treating fabric comprising treating the fabric with a fabric treatment composition comprising a textile compatible carrier and water insoluble particles having a layered structure comprising oxygen atoms and silicon and/or phosphorus atoms, and comprising organic functional groups which are bonded to silicon and/or phosphorus atoms in the layers by direct covalent bonds between the silicon and/or phosphorus atoms and a carbon atom.

DETAILED DESCRIPTION OF THE INVENTION

The present invention is based on the application to the treatment of fabric of water insoluble particles having a layered structure comprising oxygen atoms and silicon and/or phosphorus atoms, and comprising organic functional groups which are bonded to silicon and/or phosphorus atoms in the layers by direct covalent bonds to carbon ie, covalent bonds between silicon and carbon (Si—C bonds) or between phosphorus and carbon (P—C bonds).

The Water-Insoluble Particles

The present invention involves the use of water-insoluble particles having a layered structure comprising oxygen atoms and silicon and/or phosphorus atoms, and comprising organic functional groups which are bonded to silicon and/or phosphorus atoms in the layers by direct covalent bonds between the silicon and/or phosphorus atoms and a carbon atom. The term "water-insoluble", as used herein, means that the particles are soluble in distilled water at a concentration of less than 0.01 g/l, preferably less than 0.001 g/l at 20° C. Preferably, the particles will be substantially insoluble but dispersible in water at 20° C.

The water insoluble particles used in the invention are of a size such that they are not perceived as distinct particles to the touch. Preferably, the particles used in the invention have an average size of from 0.1 to 100 μm. More preferably, the particles used herein have an average size in the range of from about 1 μm to 50 μm. The size of the particles refers to their maximum dimension, such as their diameter when the particles are substantially spherical.

The layered nature of the particles preferably involves an ordered array comprising oxygen atoms and silicon and/or phosphorus atoms. The layers may also comprise other metallic and/or non-metallic atoms. Other atoms which may be present in the layers include, for example, di- and/or tri-valent metal atoms, such as of alkaline earth metals (eg, magnesium or calcium), of transition metals (eg, copper, nickel and/or zirconium), of Group IIIB of the periodic table (eg, aluminium) or of mixtures thereof. Suitable particles may comprise discrete, repeating units of layers or sheets. Layers or sheets are substantially two-dimensional arrays of atoms. Preferably, the repeating unit consists of a plurality of (eg, two or three) layers, or sheets, of atoms with a metallic atom or a mixture of metallic atoms forming the central layer and a range of non-metallic atoms bridging and/or forming the surrounding layers. Also present within the repeating unit may be a variety of atomic, ionic or molecular species, including for example, polyvalent metal ions such as sodium and/or calcium and/or hydroxonium ions.

Suitable examples of layered structures include those comprising divalent or trivalent metal ions, or a mixture thereof, in the central layer. Preferably, the central layer comprises magnesium, nickel or aluminium ions, or mixtures thereof, which are connected via oxygen atoms and/or hydroxyl groups to the surrounding layer. Preferably, the surrounding layers comprise a mixture of silicon atoms and oxygen atoms as well as other cationic and/or molecular species.

The interlayer spacing in the particles which are used in the invention is preferably greater than 10×, more preferably greater than 12×, as determined by X-ray crystallography. The interlayer spacing preferably does not exceed about 100× and, more preferably, it does not exceed about 50×.

When the central layer comprises divalent ions and the outer layer comprises silicon atoms, with bridging oxygen atoms and hydroxyl groups, the layered structure is analogous to that of talc-like smectite, or phyllosilicate clays.

Smectite clays can broadly be differentiated on the basis of the number of octahedral metal-oxygen arrangements in the central layer for a given number of silicon-oxygen atoms in the outer layer. Those clays featuring primarily divalent metal ions comprise the prototype talc and the members hectorite, saponite, sauconite and vermiculite. When the clays feature primarily trivalent metal ions the structures change and now comprise the prototype pyrophillite, montmorillonite, nontronite and volchonskoite.

The water insoluble particles comprise one or more organic functional groups. The functional groups in each particle may be a single type of functional group or a mixture of different types of functional groups. These organic functional groups can be at least partly responsible for conferring the desired properties on the fabric, after treatment with the particles or compositions comprising the particles.

The organic functional groups comprise at least one carbon atom and are directly bound, by a covalent bond from a carbon atom in the organic functional group to a silicon or phosphorus atom which forms part of a layer in the water-insoluble particles. Preferred organic functional groups include alkyl, alkenyl, alkynyl, aralkyl and aryl groups, optionally substituted. Optional substituents include, for example, one or more of the same or different groups selected from halo, OR', $OCOR^1$, $NR^2R^3$, $N^+R^4R^5R^6$, COX, NCO, $NO_2$, $SO_2R^7$, $SO_3H$, $H_2PO_4$, $PO(OR')_2$ and heterocycloalkyl, wherein X is selected from halo, $OR^8$, $OCOR^9$, OH, H and $R^{10}$ and R', $R^1$, $R^2$, $R^3$, $R^4$, $R^5$, $R^6$, $R^7$, $R^8$, $R^9$ and $R^{10}$ are independently selected from $C_1$ to $C_6$ alkyl, $C_2$ to $C_6$ alkenyl and hydrogen. When the organic functional groups comprise acid groups, such as $CO_2H$, $SO_3H$, OH or $H_2PO_4$, they may be in the form of the corresponding deprotonated ions (eg, as sodium salts).

The term "halo" means fluoro, chloro, bromo or iodo. Suitable halo-substituted groups include, for example, fluoroalkyl, such as perfluoroalkyl.

The term "alkyl" includes $C_1$ to $C_{20}$ (preferably $C_1$ to $C_{12}$, more preferably $C_1$–$C_6$) branched or unbranched acyclic groups and, for $C_3$ to $C_8$, cyclic groups. Acyclic alkyl groups may be substituted in the chain by one or more S or O atoms or NH groups and/or substituted on the chain by one or more ═O groups. Optionally substituted acyclic alkyl groups include, for example, optionally substituted methyl, ethyl, n-propyl, iso-propyl, n-butyl, iso-butyl, tert-butyl, n-pentyl and n-hexyl. Optionally substituted cycloalkyl groups include, for example, optionally substituted cyclopropyl, cyclobutyl, cyclopentyl and cyclohexyl. Cycloalkyl groups may be substituted in the ring by one or more S or O atoms or NH groups and/or substituted on the ring by one or more ═O groups.

The terms "alkenyl" and "alkynyl" are defined similarly to the term "alkyl" but include, respectively, one or more carbon-carbon double bonds or carbon-carbon triple bonds.

The term "aryl" includes aromatic, heterocyclic and carbocyclic ring compounds, which may be single rings or fused rings. Heterocyclic aryl groups include, for example, pyridyl, pyrrolyl, thiophenyl and furanyl. Carbocyclic aryl groups include phenyl and naphthyl.

The term "aralkyl" means alkyl substituted with aryl eg, benzyl.

The term "heterocycloalkyl" includes $C_3$ to $C_8$ (preferably $C_3$ to $C_6$) cyclic groups containing one or more heteroatoms in the ring. Heteroatoms include one or more of the same or different groups or atoms selected from O, S, NH and N-alkyl. Heterocyclic alkyl groups may be substituted in the ring with, for example, one or more keto (C═O) groups. Heterocycloalkyl groups therefore include, for example, epoxide, aziridine, azetidinium, lactones, azalactones and cyclic anhydrides (eg, succinic anhydride) and mono- and di-saccharides (eg, a group derived from glucose, fructose or sucrose). Polysaccharides (including, for example, dextrins, cyclodextrins, dextrans, cellulose and modified cellulose) are also suitable functional groups for use in the invention.

It has been found that, in a preferred embodiment of the invention, the use of fabric compositions comprising water-insoluble particles having a layered structure and comprising one or more organic functional groups which are capable of self cross-linking and/or reacting with the fibres of the fabric leads to improved anti-wrinkle, ie, crease reduction, performance of fabrics, without the disadvantages of conventional cross-linking agents such as butane-1,2,3,4-tetracarboxylic acid (BTCA). Hence, fabrics treated with compositions of the invention comprising water-insoluble particles as described above have good anti-wrinkle properties but are less stiff, less prone to discolouring and less susceptible to tearing than fabrics treated with some conventional cross-linking agents.

In a preferred embodiment of the invention, the organic functional group is capable of self cross-linking and/or of forming covalent bonds with the surface of a fibre eg, cellulosic and/or proteinaceous fibres. Cellulosic fibres possess hydroxyl groups; proteins possess a range of functional groups. Preferably, the organic functional groups comprise electrophilic groups which are capable of reacting with hydroxyl groups for reaction with, for example, cellulosic fibres or proteinaceous fibres and/or thiol groups for more specific reaction, for example, with proteinaceous fibres. Suitable examples of electrophilic groups include: acid anhydrides, epoxides, acid chlorides, isocyanates, azetidinium-containing groups, carboxylic acids, vinyl sulfones, aldehydes, ketones, enol esters, aziridines, azalactones and mixtures thereof. The epoxide group is especially preferred. In fabric treated according to the invention, with these compositions of the invention, the water-insoluble particles may be cross-linked to each other and/or bound to the surface of fabric fibres. Preferably, the water insoluble particles are cross-linked to each other and bound to the fibres. The particles may act to confer anti-wrinkle benefits through a range of other physical and/or chemical mechanisms.

The water insoluble particles are preferably of a clay functionalised by the introduction of organic functional groups during its synthesis. The organic functional groups may be converted to different organic functional groups by reaction of the clay, after it has been synthesised, with an appropriate reagent, to form another clay which is suitable for use in the present invention. Appropriate reagents and reaction conditions for the interconversion of functional groups are well-known to those skilled in the art. Alternatively, the clay may need no conversion of functional groups prior to use in the compositions of the invention.

More preferably, the water insoluble functionalised particles are of the general class of inorganic-organic hybrid clays known as an organo(phyllosilicates). Examples of synthetic methods for forming organo(phyllosilicates), or organoclays, are described in *J. Mater. Chem.*, vol. 8, 1998, p 1927–1932, *J. Phys. Chem. B.* 1997, 101, 531–539, *J. Chem. Soc., Chem. Commun.*, 1995, 241–242 and *J. Mater. Chem.* 2000, 10, 1457–1463. In these examples, the organic functionality is introduced into the clay by assembling a metal oxide/hydroxide framework in the presence of an organotrialkoxysilane. The water insoluble particles of the present invention are preferably produced according to this method. Therefore, the water-insoluble particles are preferably obtainable by the hydrolysis of an organotrialkoxysilane in the presence of at least one di- or tri-valent metal ion in an alcoholic solution at a suitable pH appropriate to the metal ion used. The skilled person is readily able to determine a suitable pH for the hydrolysis on the basis of the teaching of the prior art. For example, for magnesium, the pH is typically greater than 7 and for aluminium it will typically be in the range of from pH 5–12 (preferably from 5.5 to 6.5).

Other water insoluble functionalised particles are also suitable for use in the present invention. For example, metal organophosphates (including zirconium (which is preferred), titanium, hafnium, vanadium (V), magnesium (II), manganese (II), calcium (II), cadmium (II), lanthanum (III), samarium (III), cerium (III) and iron (III)) can be prepared by a precipitation reaction involving mixing a solution of the metal ion and a solution of an organic phosphoric or phosphinic acid. Crystallisation of the layered structure results. Synthetic routes of this type are described, for example, in *Acc. Chem. Res.*, 1992, 25, 420–427, *Chem. Mater.* 1994, 6, 2227, *Acc. Chem. Res.*, 1978, 11, 163 and *Chem. Rev.*, 1988, 88, 55. Zirconium organophosphates, and other metal organophosphates, typically comprise, in each layer, a plane of metal atoms linked together by phosphonate groups. The metal atoms are preferably octahedrally coordinated by oxygen atoms, with the three oxygen atoms of each phosphonate tetrahedron bound to three different metal atoms.

The preferred water-insoluble particles used in the invention are organoclays and more preferably three-layer clays consisting of a central metal-containing layer, as in the analogous talc-like structures, together with bridging oxygen and hydroxyl groups and silicon atoms in the outer two layers. Unlike talc, however, the outer silicon atoms are attached to organic groups as well as oxygen atoms. Preferably, a high proportion (for example greater than 50% by number, more preferably greater than 75% by number) of the Si atoms in any given organoclay particle are covalently bonded to at least one carbon atom. However, the layered structure may contain varying amounts of Si atoms that are not covalently bonded to a carbon atom, and these particles will also operate effectively within the scope of the invention.

The organoclays preferably comprise silicon or phosphorus, oxygen, metal (eg, magnesium, nickel, zirconium or aluminium or mixtures thereof) and, optionally, hydrogen atoms, in addition to the organic functional groups and the organic functional groups in the water insoluble particles.

Preferred particles of the invention may have the general formula $$M_xSi_{8-y}O_{16-3y}(OH)_{4+3y},$$

wherein:

M is Mg, Ni, Cu or Al x is 6 when M is Mg, Ni or Cu; and 4 when M is Al y is between 0 and 4

In a particularly preferred example of the invention, the organoclay may be represented by the formula $Mg_6Si_8R_8O_{16}(OH)_4$, with a silicon to magnesium ratio of 1.33 and where R is any one of the suitable organic functional groups listed above. R may, for example, comprise a reactive functional group, as described hereinbefore, and a divalent linker group such as a $C_1$ to $C_{18}$ (preferably $C_1$ to $C_{12}$) branched or unbranched alkylene group eg, $(CH_2)_n$ where n is an integer from 1 to 6. The linker group is bound at one end to the organic functional group capable of reacting with a cellulosic or proteinaceous fibre and at the other end to a silicon atom. Again, the particles are preferably functionalised by virtue of a direct Si—C covalent bond created during the synthesis of the whole material, not by synthetic post-modification (eg, by grafting onto the surface of a preformed clay particle); this allows far more organic functional groups to be incorporated at the surface of, and/or within the layers of, the water-insoluble particle.

Treatment of fabric with the fabric treatment compositions of the invention comprises any step in which the compositions are applied to fabric.

Typically, application occurs with the composition in the form of an aqueous dispersion or suspension. Treatments include laundering of the fabric.

The fabric preferably comprises synthetic or non-synthetic fibres or mixtures thereof. Non-synthetic fibres include, for example, cellulosic (eg, cotton) or proteinaceous (eg, wool or silk) fibres. Synthetic fibres include, for example, nylons and polyesters.

If the compositions of the invention comprise water-insoluble particles which are capable of self-cross-linking and/or of forming covalent bonds with cellulosic and/or proteinaceous fibres, fabric treated with the composition of the invention is preferably subsequently heated. In laundering the fabric, this heating may be provided during the laundering cycle or possibly during tumble or line drying. Preferably, however, the heat necessary for ensuring maximum coverage of the fibre with the water insoluble particles is provided during ironing. Typically, the heating step involves heating the fabric to a temperature in the range of from 50 to 150° C., more preferably from 60 to 100° C.

The invention may also be carried out in non-domestic environments. For example, the method of the invention may involve the treatment of fabric (before or after it has been made into finished articles such as garments) on an industrial scale.

The water insoluble particles having a layered structure and comprising one or more organic functional groups are preferably present in the fabric treatment composition in an amount of from 0.01% to 50% by weight of the composition; more preferably they are present in an amount of from 0.1% to 20% by weight of the composition, most preferably 0.1–10% by weight of the composition.

The fabric treatment composition contains one or more textile compatible carriers.

The nature of the textile compatible carrier will be dictated to a large extent by the stage at which the composition of the invention is used in a laundering process, the compositions being capable of being used, in principle, at any stage of the process. For example, where the compositions are for use as main wash detergent compositions, which is preferred, the one or more textile compatible carriers comprise a detergent active compound. Where the compositions are for use in the rinsing step of a laundering process, the one or more textile compatible carriers may comprise a fabric softening and/or conditioning compound.

The compositions of the invention preferably comprise a perfume, such as of the type which is conventionally used in fabric care compositions. The compositions may be in the form of packaged articles which are labelled as being for use in a domestic laundering process.

The textile compatible carrier is a component which can assist in the interaction of the first component with the fabric. The carrier can also provide benefits in addition to those provided by the first component e.g. softening, cleaning etc.

If the composition of the invention is to be used before, or after, the laundry process it may be in the form of a spray or foaming product.

The laundering processes of the present invention include the large scale and small scale (eg domestic) cleaning of fabrics. Suitable fabrics include fabrics which are in the form of garments. Preferably, the processes are domestic.

Detergent Active Compounds

If the composition of the present invention is in the form of a detergent composition, the textile-compatible carrier may be chosen from soap and non-soap anionic, cationic, nonionic, amphoteric and zwitterionic detergent active compounds, and mixtures thereof.

Many suitable detergent active compounds are available and are fully described in the literature, for example, in "Surface-Active Agents and Detergents", Volumes I and II, by Schwartz, Perry and Berch.

The preferred textile-compatible carriers that can be used are soaps and synthetic non-soap anionic and nonionic compounds.

Anionic surfactants are well-known to those skilled in the art. Examples include alkylbenzene sulphonates, particularly linear alkylbenzene sulphonates having an alkyl chain length of $C_8$–$C_{15}$; primary and secondary alkylsulphates, particularly $C_8$–$C_{15}$ primary alkyl sulphates; alkyl ether sulphates; olefin sulphonates; alkyl xylene sulphonates; dialkyl sulphosuccinates; and fatty acid ester sulphonates. Sodium salts are generally preferred.

Nonionic surfactants that may be used include the primary and secondary alcohol ethoxylates, especially the $C_8$–$C_{20}$ aliphatic alcohols ethoxylated with an average of from 1 to 20 moles of ethylene oxide per mole of alcohol, and more especially the $C_{10}$–$C_{15}$ primary and secondary aliphatic alcohols ethoxylated with an average of from 1 to 10 moles of ethylene oxide per mole of alcohol. Non-ethoxylated nonionic surfactants include alkylpolyglycosides, glycerol monoethers, and polyhydroxyamides (glucamide).

Cationic surfactants that may be used include quaternary ammonium salts of the general formula $R_1R_2R_3R_4N^+ X^-$ wherein the R groups are independently hydrocarbyl chains of $C_1$–$C_{22}$ length, typically alkyl, hydroxyalkyl or ethoxylated alkyl groups, and X is a solubilising cation (for example, compounds in which $R_1$ is a $C_8$–$C_{22}$ alkyl group, preferably a $C_8$–$C_{10}$ or $C_{12}$–$C_{14}$ alkyl group, $R_2$ is a methyl group, and $R_3$ and $R_4$, which may be the same or different, are methyl or hydroxyethyl groups); and cationic esters (for example, choline esters) and pyridinium salts.

The total quantity of detergent surfactant in the composition is suitably from 0.1 to 60 wt % e.g. 0.5–55 wt %, such as 5–50 wt %.

Preferably, the quantity of anionic surfactant (when present) is in the range of from 1 to 50% by weight of the total composition. More preferably, the quantity of anionic surfactant is in the range of from 3 to 35% by weight, e.g. 5 to 30% by weight.

Preferably, the quantity of nonionic surfactant when present is in the range of from 2 to 25% by weight, more preferably from 5 to 20% by weight.

Amphoteric surfactants may also be used, for example amine oxides or betaines.

The compositions may suitably contain from 10 to 70%, preferably from 15 to 70% by weight, of detergency builder. Preferably, the quantity of builder is in the range of from 15 to 50% by weight.

The detergent composition may contain as builder a crystalline aluminosilicate, preferably an alkali metal aluminosilicate, more preferably a sodium aluminosilicate.

The aluminosilicate may generally be incorporated in amounts of from 10 to 70% by weight (anhydrous basis), preferably from 25 to 50%. Aluminosilicates are materials having the general formula:

$$0.8\text{–}1.5\ M_2O.\ Al_2O_3.\ 0.8\text{–}6\ SiO_2$$

where M is a monovalent cation, preferably sodium. These materials contain some bound water and are required to have a calcium ion exchange capacity of at least 50 mg CaO/g. The preferred sodium aluminosilicates contain 1.5–3.5 $SiO_2$ units in the formula above. They can be prepared readily by reaction between sodium silicate and sodium aluminate, as amply described in the literature.

Fabric Softening and/or Conditioner Compounds

If the composition of the present invention is in the form of a fabric conditioner composition, the textile-compatible carrier will be a fabric softening and/or conditioning compound (hereinafter referred to as "fabric softening compound"), which may be a cationic or nonionic compound.

The softening and/or conditioning compounds may be water insoluble quaternary ammonium compounds. The compounds may be present in amounts of up to 8% by weight (based on the total amount of the composition) in which case the compositions are considered dilute, or at levels from 8% to about 50% by weight, in which case the compositions are considered concentrates.

Compositions suitable for delivery during the rinse cycle may also be delivered to the fabric in the tumble dryer if used in a suitable form. Thus, another product form is a composition (for example, a paste) suitable for coating onto, and delivery from, a substrate e.g. a flexible sheet or sponge or a suitable dispenser during a tumble dryer cycle.

Suitable cationic fabric softening compounds are substantially water-insoluble quaternary ammonium materials comprising a single alkyl or alkenyl long chain having an average chain length greater than or equal to $C_{20}$ or, more preferably, compounds comprising a polar head group and two alkyl or alkenyl chains having an average chain length greater than or equal to $C_{14}$. Preferably the fabric softening compounds have two long chain alkyl or alkenyl chains each having an average chain length greater than or equal to $C_{16}$. Most preferably at least 50% of the long chain alkyl or alkenyl groups have a chain length of $C_{18}$ or above. It is preferred if the long chain alkyl or alkenyl groups of the fabric softening compound are predominantly linear.

Quaternary ammonium compounds having two long-chain aliphatic groups, for example, distearyldimethyl ammonium chloride and di(hardened tallow alkyl) dimethyl ammonium chloride, are widely used in commercially available rinse conditioner compositions. Other examples of these cationic compounds are to be found in "Surface-Active Agents and Detergents", Volumes I and II, by Schwartz, Perry and Berch. Any of the conventional types of such compounds may be used in the compositions of the present invention.

The fabric softening compounds are preferably compounds that provide excellent softening, and are characterised by a chain melting Lβ to Lα transition temperature greater than 25° C., preferably greater than 35° C., most preferably greater than 45° C. This Lβ to Lα transition can be measured by DSC as defined in "Handbook of Lipid Bilayers", D Marsh, CRC Press, Boca Raton, Fla., 1990 (pages 137 and 337).

Substantially water-insoluble fabric softening compounds are defined as fabric softening compounds having a solubility of less than $1\times10^{-3}$ wt % in demineralised water at 20° C. Preferably the fabric softening compounds have a solubility of less than $1\times10^{-4}$ wt %, more preferably less than $1\times10^{-8}$ to $1\times10^{-6}$ wt %.

Especially preferred are cationic fabric softening compounds that are water-insoluble quaternary ammonium materials having two $C_{12\text{-}22}$ alkyl or alkenyl groups connected to the molecule via at least one ester link, preferably two ester links. An especially preferred ester-linked quaternary ammonium material can be represented by the formula II:

(II)

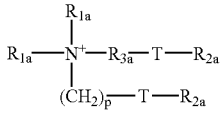

wherein each $R_{1a}$ group is independently selected from $C_{1\text{-}4}$ alkyl or hydroxyalkyl groups or $C_{2\text{-}4}$ alkenyl groups; each $R_{2a}$ group is independently selected from $C_{8\text{-}28}$ alkyl or alkenyl groups; and wherein $R_{3a}$ is a linear or branched alkylene group of 1 to 5 carbon atoms, T is

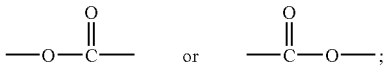

and p is 0 or is an integer from 1 to 5.

Di(tallowoxyloxyethyl) dimethyl ammonium chloride and/or its hardened tallow analogue is especially preferred of the compounds of formula (II).

A second preferred type of quaternary ammonium material can be represented by the formula (III):

(III)

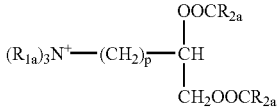

wherein $R_{1a}$, p and $R_{2a}$ are as defined above.

It is advantageous if the quaternary ammonium material is biologically biodegradable.

Preferred materials of this class such as 1,2-bis(hardened tallowoyloxy)-3-trimethylammonium propane chloride and their methods of preparation are, for example, described in U.S. Pat. No. 4,137,180 (Lever Brothers Co). Preferably these materials comprise small amounts of the corresponding monoester as described in U.S. Pat. No. 4,137,180, for example, 1-hardened tallowoyloxy-2-hydroxy-3-trimethylammonium propane chloride.

Other useful cationic softening agents are alkyl pyridinium salts and substituted imidazoline species. Also useful are primary, secondary and tertiary amines and the condensation products of fatty acids with alkylpolyamines.

The compositions may alternatively or additionally contain water-soluble cationic fabric softeners, as described in GB 2 039 556B (Unilever).

The compositions may alternatively or additionally contain the polyol polyester (eg, sucrose polyester) compounds described in WO 98/16538.

The compositions may comprise a cationic fabric softening compound and an oil, for example as disclosed in EP-A-0829531.

The compositions may alternatively or additionally contain nonionic fabric softening agents such as lanolin and derivatives thereof.

Lecithins are also suitable softening compounds.

Nonionic softeners include Lβ phase forming sugar esters (as described in M Hato et al Langmuir 12, 1659, 1666, (1996)) and related materials such as glycerol monostearate or sorbitan esters. Often these materials are used in conjunction with cationic materials to assist deposition (see, for example, GB 2 202 244). Silicones are used in a similar way as a co-softener with a cationic softener in rinse treatments (see, for example, GB 1 549 180).

The compositions may also suitably contain a nonionic stabilising agent. Suitable nonionic stabilising agents are linear $C_8$ to $C_{22}$ alcohols alkoxylated with 10 to 20 moles of alkylene oxide, $C_{10}$ to $C_{20}$ alcohols, or mixtures thereof.

Advantageously the nonionic stabilising agent is a linear $C_8$ to $C_{22}$ alcohol alkoxylated with 10 to 20 moles of alkylene oxide. Preferably, the level of nonionic stabiliser is within the range from 0.1 to 10% by weight, more preferably from 0.5 to 5% by weight, most preferably from 1 to 4% by weight. The mole ratio of the quaternary ammonium compound and/or other cationic softening agent to the nonionic stabilising agent is suitably within the range from 40:1 to about 1:1, preferably within the range from 18:1 to about 3:1.

The composition can also contain fatty acids, for example $C_8$ to $C_{24}$ alkyl or alkenyl monocarboxylic acids or polymers thereof. Preferably saturated fatty acids are used, in particular, hardened tallow $C_{16}$to $C_{18}$ fatty acids. Preferably the fatty acid is non-saponified, more preferably the fatty acid is free, for example oleic acid, lauric acid or tallow fatty acid. The level of fatty acid material is preferably more than 0.1% by weight, more preferably more than 0.2% by weight. Concentrated compositions may comprise from 0.5 to 20% by weight of fatty acid, more preferably 1% to 10% by weight. The weight ratio of quaternary ammonium material or other cationic softening agent to fatty acid material is preferably from 10:1 to 1:10.

The fabric conditioning compositions may include silicones, such as predominately linear polydialkylsiloxanes, e.g. polydimethylsiloxanes or aminosilicones containing amine-functionalised side chains; soil release polymers such as block copolymers of polyethylene oxide and terephthalate; amphoteric surfactants; smectite type inorganic clays; zwitterionic quaternary ammonium compounds; and nonionic surfactants.

The fabric conditioning compositions may be in the form of emulsions or emulsion precursors thereof.

Other optional ingredients include emulsifiers, electrolytes (for example, sodium chloride or calcium chloride) preferably in the range from 0.01 to 5% by weight, pH buffering agents, and perfumes (preferably from 0.1 to 5% by weight).

Further Optional Ingredients

Further optional ingredients in the compositions of the invention include non-aqueous solvents, perfume carriers, fluorescers, colourants, hydrotropes, antifoaming agents, antiredeposition agents, enzymes, optical brightening agents, opacifiers, dye transfer inhibitors, anti-shrinking agents, anti-wrinkle agents, anti-spotting agents, germicides, fungicides, anti-oxidants, UV absorbers (sunscreens), heavy metal sequestrants, chlorine scavengers, dye fixatives, anti-corrosion agents, drape imparting agents, antistatic agents, ironing aids, bleach systems and soil release agents. This list is not intended to be exhaustive.

The compositions of the invention may also include an agent which produces a pearlescent appearance, e.g. an organic pearlising compound such as ethylene glycol distearate, or inorganic pearlising pigments such as microfine mica or titanium dioxide ($TiO_2$) coated mica.

An anti-settling agent may be included in the compositions of the invention. The anti-settling agent, which reduces the tendency of solid particles to separate out from the remainder of a liquid composition, is preferably used in an amount of from 0.5 to 5% by weight of the composition. Organophilic quaternised ammonium-clay compounds and fumed silicas are examples of suitable anti-settling agents.

A further optional ingredient in the compositions of the invention is a flocculating agent which may act as a delivery aid to enhance deposition of the active ingredients (such as the water insoluble particles) onto fabric. Flocculating agents may be present in the compositions of the invention in amounts of up to 10% by weight, based on the weight of the organoclay. Suitable flocculating agents include polymers, for example long chain polymers and copolymers comprising repeating units derived from monomers such as ethylene oxide, acrylamide, acrylic acid, dimethylaminoethyl methacrylate, vinyl alcohol, vinyl pyrrolidone, ethylene imine and mixtures thereof. Gums such as guar gum, optionally modified, are also suitable for use as flocculating agents.

Other possible delivery aids for the water insoluble particles include, for example, the water-soluble or water-dispersible rebuild agents (eg, cellulose monoacetate) described in WO 00/18860.

Fabric Treatment Products

The composition of the invention may be in the form of a liquid, solid (e.g. powder or tablet), a gel or paste, spray, stick or a foam or mousse. Examples including a soaking product, a rinse treatment (e.g. conditioner or finisher) or a mainwash product. The composition may also be applied to a substrate e.g. a flexible sheet or used in a dispenser which can be used in the wash cycle, rinse cycle or during the dryer cycle.

The compositions may include adjunct components imparting other beneficial properties to the products e.g. lubricants, such as silicones, anti-wrinkling agents, such as lithium salts, and perfume ingredients, such as cyclodextrins and fragrances.

The invention will now be described by way of example only and with reference to the following non-limiting examples. In the examples and throughout this specification all percentages are percentages by weight unless indicated otherwise.

EXAMPLES

Examples 1 to 4

Synthesis of Organophyllosilicate: $Mg_6Si_8R_8O_{16}(OH)_4$ Si/Mg=1.33

Example 1

R=3-glycidyloxyprop-1-yl

Magnesium chloride hexachlorohydrate, $MgCl_2.6H_2O$ (8.3 mmol) was charged to a reaction vessel and dissolved in ethanol (50 ml) under fast stirring. Upon dissolution of the magnesium salt, glycidylpropyltrimethoxysilane (11.1 mmol) was added to the reaction mixture. Sodium hydroxide solution (200 ml, 0.05M, 10 mmol) was added immediately after addition of glycidylpropyltrimethoxysilane. The resultant reaction mixture was stirred at room temperature for 24 hours. The solid product of the reaction was washed in water by centrifugation and retained as slurry in water (approx. 10% by weight of solid).

Example 2

R=(3-succinicanhydride)prop-1-yl

This organoclay was synthesised according to the method of Example 1, using (1-(succinicanhydride)propyl)trimethoxysilane in place of glycidylpropyltrimethoxysilane.

Example 3

R=3-aminoprop-1-yl

This organoclay was synthesised according to the method of Example 1, using (1-aminopropyl)trimethoxysilane in place of glycidylpropyltrimethoxysilane.

Example 4

R=prop-3-en-1-yl

This organoclay was synthesised according to the method of Example 1, using 1-propenyltrimethoxysilane in place of glycidylpropyltrimethoxysilane.

Example 5

Demonstrating Improved Crease Recovery Performance of Cotton Poplin Treated with a Funtionalised Organoclay Method of Measuring Crease Recovery Performance The method described here to monitor the ability of a fabric to recover from an induced crease is used within the textile industry. Before any treatment was applied the warp direction on the fabric to be used was marked. Having done this, the fabric was saturated by padding on a solution of the organoclay (0.1 to 2% by weight of the fabric) under pressure. Excess dispersion was removed. The fabric was tumble dried and ironed flat. The ironed fabric was left to condition at 65% relative humidity (r.h.) and 20° C. for 24 hours prior to testing.

The fabric was then ready for testing. All testing was done in a test room at 65% r.h. and 20° C. using tweezers to handle the fabrics at all times, in order to prevent extraneous grease from affecting the results. Six rectangular samples, each with an area of 50 mm by 25 mm, were cut from the treated fabric, using a template, and cut such that the long edge was parallel to the warp direction. The sample was then folded in half crossways, so that each sample was a square with an area of 25 mm square.

The sample was then placed on the lower plate of a loading device such that the crease was under the weight and the ends were in line with the edge of the lower plate. The weight was then lowered down gently, not bumped, and settled using a wiggling motion. After leaving for one minute, the weight was removed and the sample transferred to from the loading device to a tester (protractor) using a pair of tweezers. The fabric was positioned and fixed such that one end touched the back-stop and the free end hung vertically. After leaving the fabric in a vertical position for 1 minute, the crease recovery angle (CRA) was measured by taking a reading from the circular scale at the index line, whereby one red line was observed, not two.

The four functionalised organoclays of Examples 1 to 4 were used in the set of experiments conducted with cotton poplin (see Table 1). In each case, an aqueous slurry of the functionalised organoclay, as obtained directly from its synthesis in Examples 1 to 4, was diluted with water to an appropriate weight percent of organoclay and applied directly to the cotton fabric by pad application.

Following the method of measuring crease recovery performance described above, it was found that deposits of 0.1–2.0% by weight of cotton poplin of the functionalised organoclay considerably improved the crease recovery performance of the cotton poplin. This was observed to be particularly the case when the functional group was capable of covalently attaching the organoclay to the cellulosic fibres.

The crease recovery performance of cotton poplin treated with 2% by weight of cotton fabric of functionalised clays is given in Table 1. Cotton poplin which had been treated with functionalised organoclays was compared with two standards: (a) cotton poplin that had been treated with a "background" basic aqueous ethanolic solution (Comparative Example 1); (b) cotton poplin treated with 2% by weight of cotton fabric of an unfunctionalised smectite-type clay (Comparative Example 2). All experiments were carried out according to the general method of measuring crease recovery performance.

The data in Table 1 clearly shows that when cotton poplin is treated with a functionalised organoclay, capable of forming covalent bonds with cellulosic fibres, the crease recovery performance of the cotton fabric is considerably improved, compared with untreated cotton poplin and cotton poplin which had been treated with an unfunctionalised clay.

TABLE 1

Crease Recovery Angle (CRA) Data for treatment of Cotton Poplin Fabric

| Example | Average CRA (degrees) |
|---|---|
| 1 | 90 |
| 2 | 84 |
| 3 | 78 |
| 4 | 71 |
| Comparative Example 1 | 67 |
| Comparative Example 2 | 71 |

In all of these examples, the lower the crease recovery angle, the greater the deviation of the crease from the vertical plane of the cotton fabric and the more extensive is the creasing ie, less successful is the antiwrinkle composition.

Example 6

Crease Assessment Following Tumble Drying

The following method was used:

Enough cotton sheeting ballast to make the dry load weight 1 kg was obtained.

Ballast was wetted in a European washing machine (Miele®) and the drum drained.

For each treatment, five replicates (40×40 cm square) of resinated cotton poplin were used.

Treatments were pad applied (0.5% and 2% on weight of fabric).

Whilst still wet from padding, the fabric squares were randomly distributed throughout the drum of the washing machine containing the ballast load.

The load (samples+ballast) was subjected to the spin cycle of the machine.

The whole load was dried on normal setting until the end of the cool down cycle (approx. 30 minutes).

Replicates were separated from the ballast and imaged.

Replicates were panelled.

30 comparisons were made against the untreated control samples in total. The following table shows treatment (row) score against treatment (column) showing the number of preferences, out of 30, for treated over untreated samples. For example, Epoxyclay (0.5%) v. Untreated=29 v.1.

| | Score Versus Untreated |
|---|---|
| Epoxyclay* (0.5%) | 29 |
| Epoxyclay* (2%) | 30 |

*The Epoxyclay was the composition of Example 1.

Example 7

The following is an example of a main wash detergent composition according to the invention.

| | Weight % |
|---|---|
| Na-LAS | 6 |
| Nonionics | 7 |
| Na-silicate | 5 |
| Na tripolyphosphate | 23 |
| Na-sulphate | 10 |
| Na-carbonate | 8 |
| Product of Example 1 | 10 (as active organoclay) |
| Water | 10 |

Make up to 100% with additional additives, eg fluorescers, bleach systems, enzymes, perfume etc.

Example 8

The following is an example of a concentrated detergent composition according to the invention.

| | Weight % |
|---|---|
| Na-LAS | 10 |
| Nonionics 7EO + 3EO | 6 |

-continued

| | Weight % |
|---|---|
| Zeolite A4 | 35 |
| Soda ash | 7 |
| Product of Example 1 | 7 (as active organoclay) |
| Water | 6 |
| Make up to 100% with minor additives | |

Example 9

The following is an example of a liquid detergent composition according to the invention.

| | Weight % |
|---|---|
| Na-LAS + nonionics | 20 |
| Na-citrate | 5 |
| Product of Example 1 | 5 |
| Water | 6 |
| Other additives: water, perfume, enzymes | |

Example 10

The following is an example of a fabric conditioner composition according to the invention.

| | Weight % |
|---|---|
| HEQ* | 5 |
| Product of Example 1 | 1 |
| Coco alcohol 20EO | 0.2 |
| Natrasol** | 0.05 |
| Minor ingredients: perfume, stabilisers | <5 |
| Deionized water | QS to 100% |

*di(hardened tallowoyloxy)trimethylammonium propane
**hydrophopically modified hydroxyethyl cellulose Example 11

The following is another example of a rinse conditioner composition according to the invention.

| | Weight % |
|---|---|
| HEQ | 5 |
| Product of Example 1 | 1 |
| Coco 20EO | 0.2 |
| Natrasol | 0.05 |
| Minor ingredients: perfume, stabilisers | <5 |
| Deionized water | QS to 100% |

Example 12

The following is another example of a rinse conditioner composition according to the invention.

| | Weight % |
|---|---|
| HEQ | 11 |
| Product of Example 1 | 0.5 |
| Coco 20EO | 0.9 |
| Tallow fatty acid | 0.9 |
| Minor ingredients: perfume, stabilisers | <5 |
| Deionized water | QS to 100% |

Example 13

The following is another example of a rinse conditioner composition according to the invention.

| | Weight % |
|---|---|
| HEQ | 12 |
| Product of Example 1 | 0.5 |
| Coco 20EO | 0.9 |
| Sucrose polyester | 4 |
| Minor ingredients: perfume, stabilisers | <5 |
| Deionized water | QS to 100% |

Example 14

The following is another example of a rinse conditioner composition according to the invention.

| | Weight % |
|---|---|
| Accosoft 460HC** | 10 |
| Product of Example 1 | 1 |
| Arquad 2HT** | 9 |
| Minor ingredients: perfume, stabilisers, thinning agent | <5 |
| Deionized water | QS to 100% |

*fabric softener (ex Stepan)
**di (hardened tallow alkyl) dimethyl ammonium chloride The following Examples 15 and 16 illustrate the conversion of organic functional groups of the day to different organic functional groups to form another clay suitable for use in the invention. Examples 15 and 16 introduce the electrophilic groups, acid anhydride and azetidinium groups respectively.

Example 15

Trimellitic-Anhydride Functionalised Clay

The previously prepared 1-aminopropyl modified clay of Example 4 (5 g) was added to anhydrous THF (50 ml) and stirred at room temperature under nitrogen for 18 hours. Trimellitic anhydride chloride (1.5 g) and potassium carbonate (1 g) were then added and the solution was stirred for a further 18 hours. The clay and potassium salt were then filtered off and washed with water (200 ml) and finally THF (50 ml). The clay was then dried under vacuum at 40° C. for 8 hours to gived an off-white material (5.1 g).

Example 16

Azetidinium-Functinalised Clay

The previously prepared 1-aminopropyl modifed clay of Example 4 (5 g) was added to anhydrous THF (50 ml) and stirred at room temperature under nitrogen for 18 hours. Epichlorohydrin (1-chloro-2,3-epoxypropane; 1 g) was then introduced and the reaction stirred for a further 18 hours at room temperature and under nitrogen. The clay was then filtered off, washed with THF (100 ml)and dried under vacuum at 40° C. for 8 hours to give a white material (4.9 g).

Example 17

An organoclay was synthesised according to the method of Example 1 using diethoxyphosphoryl ethyl triethoxysilane in place of glycidylpropyltrimethoxysilane.

What is claimed is:

1. Fabric treatment composition comprising a textile compatible carrier and water insoluble particles having a layered structure comprising oxygen atoms and silicon and/or phosphorus atoms, and comprising organic functional groups which are bonded to silicon and/or phosphorus atoms in the layers by direct covalent bonds between the silicon and/or phosphorus atoms and a carbon atom.

2. Composition according to claim 1 wherein said organic functional groups are selected from groups which are capable of self cross-linking and/or of forming covalent bonds to cellulosic and/or proteinaceous fibres.

3. A composition according to claim 1 wherein said organic functional groups comprise electrophilic groups.

4. A composition according to claim 1 wherein said organic functional groups comprise thiol groups.

5. A composition according to claim 1 wherein said one or more organic functional groups are selected from the group consisting of: acid anhydrides, epoxides, acid chlorides, isocyanates, azetidinium-containing groups, carboxylic acids, vinyl sulfones, aldehydes, ketones, enol esters, aziridines, azalactones and mixtures thereof.

6. A composition according to claim 1 wherein said water insoluble particles comprise layers which further comprise atoms selected from magnesium, aluminium, nickel, zirconium and mixtures thereof.

7. A composition according to claim 1 wherein said water insoluble particles are of a clay in which said organic functional groups have been introduced during formation of the clay.

8. A composition according to claim 1 wherein said water insoluble particles are of an organophyllosilicate.

9. A composition according to claim 1 which is a main wash detergent composition and wherein said textile compatible carrier comprises a detergent active compound.

10. A composition according to claim 1 which is a fabric conditioner and wherein said textile compatible carrier comprises one or more compounds selected from the group consisting of fabric softening and conditioning agents.

11. A composition according to claim 1 further comprising one or more components selected from the group consisting of builders and enzymes.

12. A composition according to claim 1 comprising from 0.01% to 50% by weight of said water insoluble particles.

13. A composition according to claim 12 comprising from 0.1% to 20% by weight of said water insoluble particles.

14. A method of treating fabric comprising treating the fabric with water insoluble particles having a layered structure comprising oxygen atoms and silicon and/or phosphorus atoms, and comprising organic functional groups which are bonded to silicon and/or phosphorus atoms in the layers by direct covalent bonds between the silicon and/or phosphorus atoms and a carbon atom.

15. The method of claim 14 wherein said treatment is part of a domestic laundering process.

16. A method according to claim 14 which comprises the step of heating the treated fabric.

* * * * *